US006988495B1

(12) United States Patent
Van Hoorn

(10) Patent No.: US 6,988,495 B1
(45) Date of Patent: Jan. 24, 2006

(54) BOW GRIP ASSEMBLY

(76) Inventor: John C. Van Hoorn, 6109 McCullom Lake Rd., Wonder Lake, IL (US) 60097

( * ) Notice: Subject to any disclaimer, the term of this patent is extended or adjusted under 35 U.S.C. 154(b) by 0 days.

(21) Appl. No.: 10/901,817

(22) Filed: Jul. 29, 2004

(51) Int. Cl.
*F41B 5/00* (2006.01)

(52) U.S. Cl. ..... 124/88

(58) Field of Classification Search ..... 124/23.1, 124/86, 88
See application file for complete search history.

(56) References Cited

U.S. PATENT DOCUMENTS

| | | | | |
|---|---|---|---|---|
| 3,397,685 A | | 8/1968 | Walker | |
| 3,407,799 A | * | 10/1968 | Bennett | 124/88 |
| 3,538,902 A | | 11/1970 | Fowkes | |
| 3,814,074 A | | 6/1974 | Wood | |
| 3,814,075 A | | 6/1974 | Hoyt, Jr. | |
| 3,821,946 A | | 7/1974 | Griggs | |
| 3,840,944 A | | 10/1974 | Gresley | |
| 3,844,268 A | | 10/1974 | Ikeya | |
| 4,787,361 A | * | 11/1988 | Vyprachticky | 124/88 |
| 4,926,835 A | | 5/1990 | Peck | |
| 4,966,124 A | | 10/1990 | Burling | |
| 5,081,979 A | | 1/1992 | Burling | |
| 5,241,945 A | | 9/1993 | Shepley | |
| 5,243,958 A | | 9/1993 | Shepley, Jr. | |
| 5,469,834 A | | 11/1995 | Higgins et al. | |
| 5,615,663 A | | 4/1997 | Simonds | |
| 5,842,460 A | | 12/1998 | Barber | |
| 5,992,403 A | | 11/1999 | Slates | |
| 6,415,780 B1 | | 7/2002 | Proctor | |

* cited by examiner

*Primary Examiner*—John A. Ricci
(74) *Attorney, Agent, or Firm*—Mathew R. P. Perrone, Jr.

(57) ABSTRACT

A bow grip assembly fits on a bow and has a bearing assembly mounted between the grip assembly and the bow, thereby allowing an archer to grip the bow; while at least minimizing the effect of torque on the bow and on a sighting system for the bow each time the bow is gripped, and reducing or eliminating a twisting of the bow.

10 Claims, 8 Drawing Sheets

BOW GRIP ASSEMBLY

This invention relates to a handgrip for the bow of an archer, and more particularly, to a handgrip for the bow of an archer or a bow grip assembly being supported by bearings in relation to the bow.

BACKGROUND OF THE INVENTION

Whether an archer shoots at least one arrow for pleasure, as in a tournament; or for necessity, as in obtaining food; it is critical that the arrow flies in a true path toward the desired target. For such accuracy to be achieved, the archer must hold the bow in substantially the same manner every time.

In archery, the forehand is the hand which holds the riser or the mainframe of the bow. If the archer does not use the forehand to hold the bow in the same manner every time, the distance between the actual striking point of the arrow and the striking point indicated by the sighting system of the bow will be unacceptable. The reason for this problem is that the forehand does not make contact with the grip of the bow at exactly the angle and manner every time the archer prepares to shoot an arrow.

One method of gripping the bow in substantially the same manner every time is to make the gripping surface of the bow as thin as possible. Some archers even remove the gripping surface of the bow completely and replace it with a small piece of tape. While this reduces the chance of varying the grip, it does not eliminate such an action and greatly reduces the comfort of handling the bow.

Any slight twist in the wrist or different grip on the bow is compounded both by the distance to the archer's target and by all sighting systems and mechanisms. Shooting a bow that is twisted will cause an erratic arrow flight. An arrow that flies erratically will not hit the target at the same point as a true flying arrow.

This problem is highly compounded by any awkward stance or body position that the archer must assume in while hunting, or in tournament situations. Wearing gloves while shooting a bow changes the archer's grip. It is at least substantially impossible to hold the bow in the same manner as with gloves on and as with gloves off. Wearing gloves in a hunting situation is very common. Wearing gloves or mittens is a necessity while hunting in cold weather.

The main reason, that the distance between where an arrow will hit a target and where the archer's sighting system indicates the arrow will hit the target is in jeopardy, is that the archer will never be able to hold the bow in his forehand in exactly the same manner every time he or she picks up a bow and shoots an arrow.

When the bow grip is twisted on a vertical plane, the sight impact point will twist in the direction the bow grip is twisted. The reason for this is the sight is always mounted to the riser of the bow.

The front of the arrow sits on the arrow rest. When the bow is twisted, the rest will only move slightly because it is virtually on a common axis with the twisting bow. Therefore the arrow's path has not changed, but the sight line will move with the twisted riser. The arrow will fly the same path as before the riser was twisted. The sight will give the archer a false reading. As a result, when the archer feels that the sight is aimed at target, the archer is actually moving the arrow off target.

In order to hit the target consistently with a bow of the prior art, the archer must have his forehand grip on the bow exactly the same every time. The archer also will have to judge the distance to the target correctly, as well as have to hold his sighting system on the target as the bow is released.

It is very important for an archer to be able to hit the target with the first arrow shot out of a bow every day, in all conditions, wearing gloves, or not. It is also very uncommon to have two different archers shoot the same bow and hit the target in the same place. This is primarily due to the fact that two individuals cannot grip the bow the same way.

Many archers shoot their bows with a device called a release aid. This device holds the bow string back and releases the string by pulling a lever or pushing a button. This is much like the trigger of a gun. A common mistake made by archers, who shoot with a release aid, is that they do not make the release of the arrow a surprise.

Most, if not all professional archers or shooters use a back tension release style, in order to surprise even a professional shooter. This is to eliminate a condition called target panic. This term is used to describe the flinching an archer may do at the time of, or just before the release of the arrow. The flinching will also cause the wrist angle on the grip to change to a degree.

SUMMARY OF THE INVENTION

Among the many objectives of this invention is the provision of a bow grip assembly, which substantially eliminates or minimizes the distance; between where an arrow will hit a target, and where the archer's sighting system tells the archer the arrow will hit the target.

A further objective of this invention is the provision of a bow grip assembly, which substantially prevents twisting of the bow as a result of the archer's grip or shooting position.

Yet a further objective of this invention is the provision of a bow grip assembly, which minimizes or avoids flinching.

A still further objective of this invention is the provision of a bow grip assembly, which allows for wearing of gloves, while using a bow without a substantial effect on a desired position of the bow caused by twisting or torquing of the bow.

Another objective of this invention is the provision of a bow grip assembly, which minimizes the effect on a bow from a change in the wrist position.

Yet another objective of this invention is the provision of a bow grip assembly, which minimizes the effect of flinching.

These and other objectives of the invention (which other objectives become clear by consideration of the specification, claims and drawings as a whole) are met by providing a bow grip assembly having a bearing assembly mounted between the grip assembly and the bow; thereby allowing an archer to grip the bow somewhat differently each time the archer shoots and arrow and still have the arrow fly true to its target, while at least minimizing the effect on torque on the bow and on a sighting system for the bow each time the bow is gripped, and substantially reducing or eliminating a twisting of the bow.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

The bow grip assembly of this invention substantially eliminates or minimizes the distance; between where an arrow will hit a target, and where the archer's sighting system tells the archer the arrow will hit the target. This bow grip assembly will eliminate all the above problems as related to gripping and holding the bow. This device will also virtually eliminate the vertical deviance between where the sight says the arrow will hit and the actual path or impact point of the arrow. It will at least minimize erratic arrow flight caused by bad shooting form.

This bow grip assembly includes a bearing assembly and a handgrip. The handgrip is mounted to the bow by a unique plastic device designed to be snap fitted onto the bow over the bearing assembly. The bearing assembly supports a series of ball bearings, needle bearings and combinations thereof. Ball and needle bearings, or ball bearings alone are preferably used to eliminate any drag or torque generated from the archer's wrist to the bow.

For attachment to the bow, the bearing assembly uses screws, nuts and bolts, or glue. Modification of the bow to have screw apertures provides the most preferred attachment.

Figure 1:
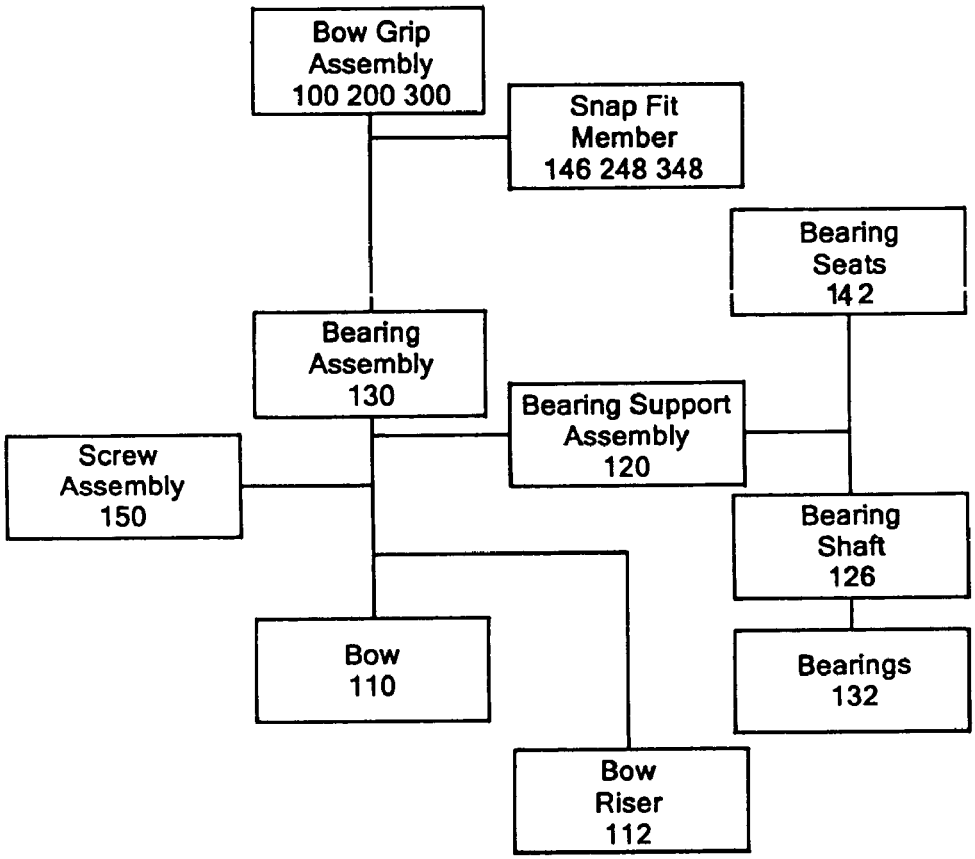
FIG. 1 depicts a block diagram of a first bow grip assembly 100 of this invention.

Referring now to FIG. 1, a first bow grip assembly 100 attaches to a bearing assembly 130 which attaches to a bow 100. The bearing assembly includes of a bearing support assembly 120 and a screw assembly 150. The bearing support assembly 120 further includes a bearing support shaft 126 with bearing assembly 130 thereon and cooperating therewith. The screw assembly 150 allows the bearing assembly 130 to be securely attached to the bow riser 112 of bow 110.

The first hand grip 140 includes bearing seat 142, which create a fitting site 144 for snap fit member 146 and allow the first hand grip 140 to be securely attached onto bearing assembly 130. With first hand grip 140 securely attaching to bearing assembly 130, which are attached to bearing support shaft 126, which is securely attached to bow riser 112 using screw assembly 150, first hand grip 140 is securely attached to bow 110 and yet can move about an axis parallel to bow riser 112.

Figure 2:
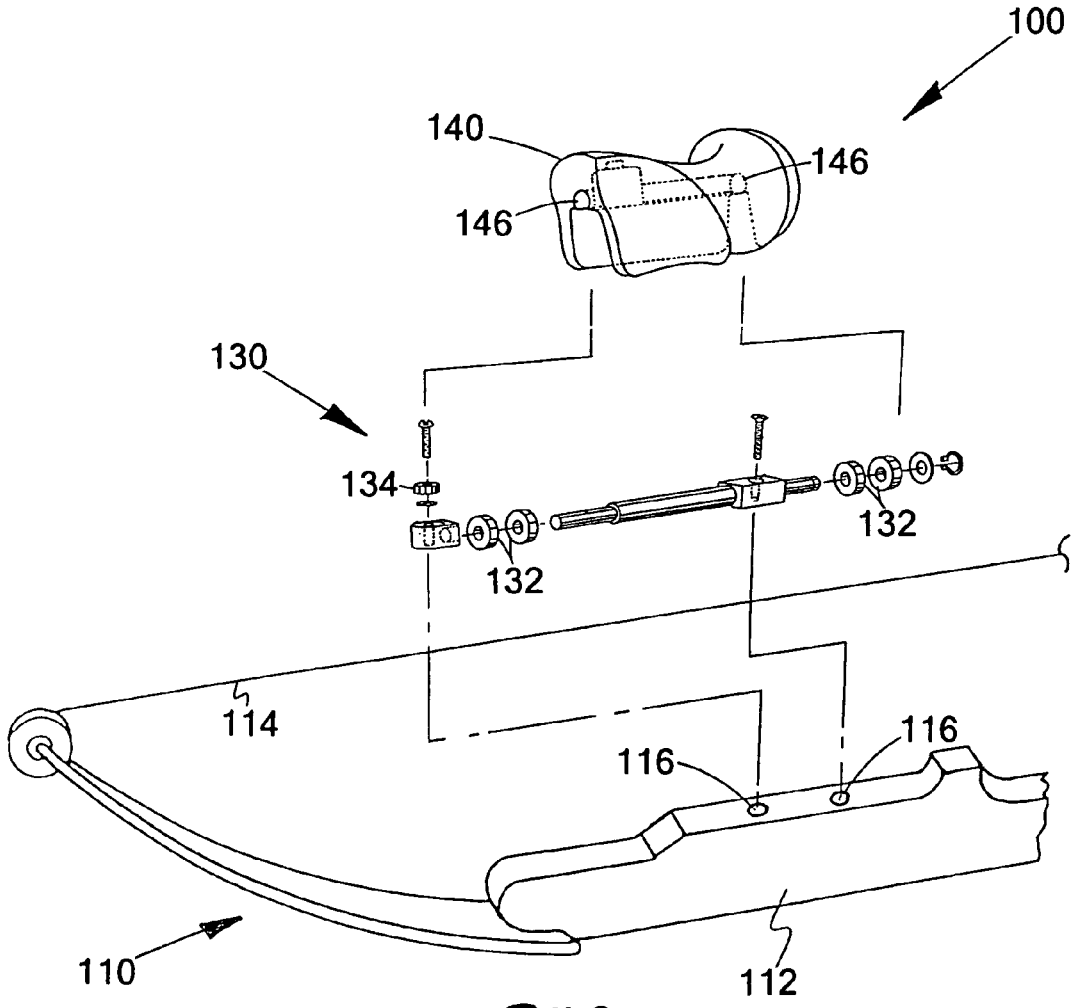
FIG. 2 depicts an exploded perspective view of a first bow grip assembly 100 of this invention mounted on a bow 110.
Figure 3:
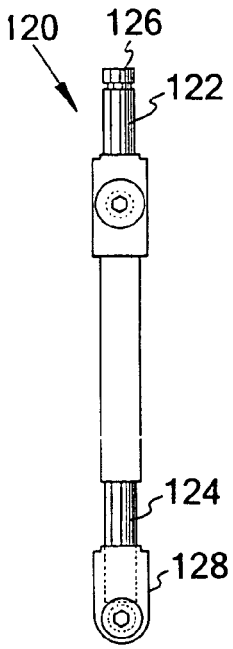
FIG. 3 depicts a top plan view of bearing support assembly 120 for first bow grip assembly 100 of this invention.
Figure 4:
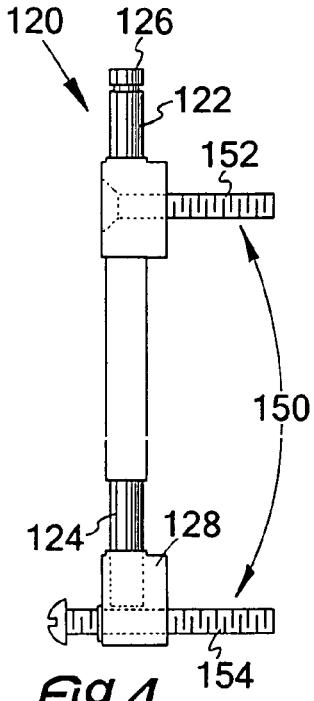
FIG. 4 depicts a side view of bearing support assembly 120 for first bow grip assembly 100 of this invention.
Figure 6:
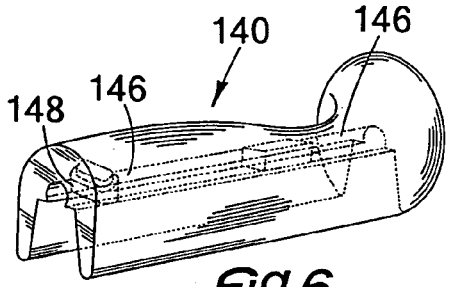
FIG. 6 depicts a perspective view of first hand grip 140 for first bow grip assembly 100 of this invention.
Figure 7:
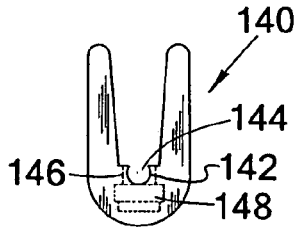
FIG. 7 depicts a bottom plan view of first hand grip 140 for first bow grip assembly 100 of this invention.
Figure 5:
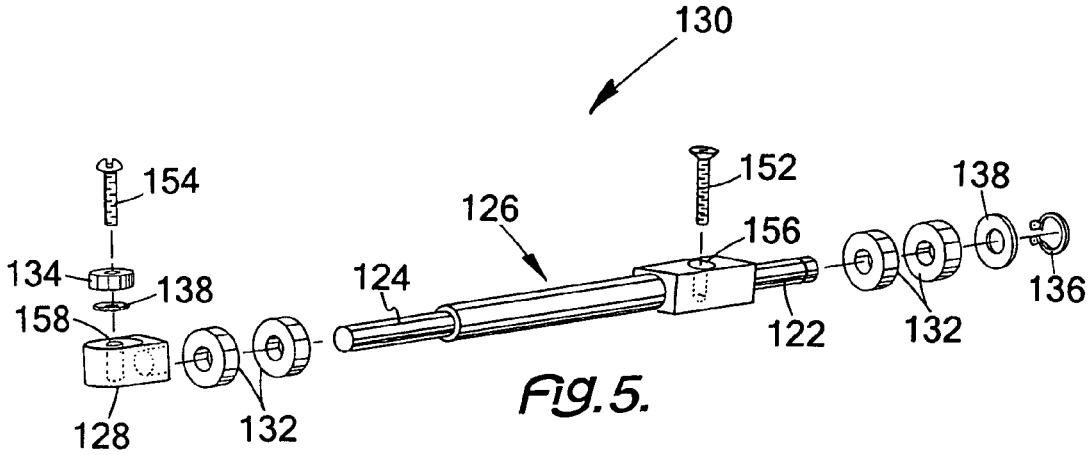
FIG. 5 depicts an exploded perspective view of bearing assembly 130 for first bow grip assembly 100 of this invention.

Adding FIG. 2, a first embodiment of this invention is depicted with a first bow grip assembly 100 mounted on a bow 110. The piece of the first hand grip 140 that is in contact with the archer's forehand is plastic. This allows the handle or first hand grip 140 to be secured to the bearing assembly 130 by a snap fit member 146 around the ball bearings 132. The plastic first hand grip 140 will also insulate the archer's hand from temperature variances in the riser 112 for the bow 110 in cold conditions.

Preferably, the piece of the first hand grip 140 that is in contact with the archer's forehand is fabricated out of DELRIN or a comparable piece of plastic. DELRIN is a registered trademark of E. I. duPont de Nemours Corporation of Delaware.

Adding FIG. 3, FIG. 4, FIG. 5, FIG. 6 and FIG. 7, the ball bearings 132 are located at a first end 122 and a second end 124 of bearing support shaft 126. Although the use of ball bearings 132 is preferred, the use of needle bearings, sleeve bearing, journal bearings or other types of bearings may be used. Roller bearing support shaft 126 also contains a transverse bearing support bracket 128 located at the second end 124.

Transverse bearing support bracket 128 receives second end 124 of bearing support shaft 126 and allows transverse ball bearing 134 to be mounted onto bearing support assembly 120. First end screw 152 and second end screw 154 allows bearing assembly 130 to be securely mounted onto bow riser 112 of bow 110. Other adhesives or fasteners may also be used to attach bearing assembly 130 onto bow riser 112.

The bearing support assembly 120 is mounted to the riser 112 of the bow 110 by screw assembly 150 in place of a conventional bow grip using bow riser apertures 116 to receive first end screw 152 and second end screw 154. First end screw 152 passes through first end aperture 156 and second end screw 154 passes through transverse bearing support bracket aperture 158. It is also possible for the bearing support assembly 120 to be machined into the riser 112, by a manufacturer with very little addition to the cost of the machining of the riser 112.

The method of snapping the handle or first hand grip 140 on the ball bearings 132 is clear from the drawings of the first hand grip 140. First hand grip 140 includes bearing seats 142. With a fitting site 144 portion of the bearing seats 142 cut out, the plastic first hand grip 140 has snap fit member 146, which will snap over the ball bearings 132. Further, transverse bearing slot 148 receives transverse bearing 134 and prevents first hand grip 140 of bow 110 from moving up or down in a direction parallel to the bow riser 112. The combination of snap fit member 146 and transverse bearing slot 148 results in the first hand grip 140 remaining very secure on the bearing support assembly 120. This also makes the first hand grip 140 easy to remove if necessary.

The ball bearings 132 mounted in or attached to the bearing support assembly 120, with that bearing support assembly attached to the bow riser 112, allow the hand grip 140 to move freely about a vertical axis, assuming the bow 110 is held in a vertical position. The grip moves about a vertical axis when bow string 114 is being pulled and bow 110 experiences torque forces. Location of the end transverse ball bearing 134 inside transverse ball bearing slot 148 also prevents any up or down motion to the plastic grip.

The ball bearings 132 located at the first end 122 of bearing support shaft 126 can be held in place by snap rings 136, c-clips, or some other suitable manner. Although a washer 138 is preferably placed between ball bearings 132 and snap ring 136, it is not required. The ball bearings 132 located at the second end 124 of bearing support shaft 126 can be held in place by transverse bearing support bracket 128 and transverse bearing end can be held in place with second end screw 154.

The pressure when pulling a bow 110 back is always focused up and forward on first hand grip 140 of bow 110. The bearing support assembly 120 bears the forward pressure generated by pulling the string 114 on the bow 110. With this pressure assistance, torque or twisting on the bow 110 is greatly reduced, if not eliminated.

By allowing the first hand grip 140 to move on ball bearings 132 while bow string 114 of bow 110 is drawn, the first bow grip assembly 100 in this invention is free to move without friction and minimizes or practically eliminates the effect of an archer not placing his or her hand in the exact place on first hand grip 140 every time he or she shoots an arrow. This invention even minimizes the effect of an archer wearing gloves. This invention provided by the first bow grip assembly 100 also minimizes or practically eliminates any effect due to a change in the wrist position and any effect of flinching by the archer.

Movement of first hand grip 140 around a vertical axis also minimizes the twisting of bow 110 caused by torque forces, when bow string 114 is pulled. Minimization of the effect of those torque forces thereby minimizes the difference between the location of where an arrow is actually aimed and where the archer's sighting mechanism(s) show the archer where the arrow is aimed.

Figure 8:
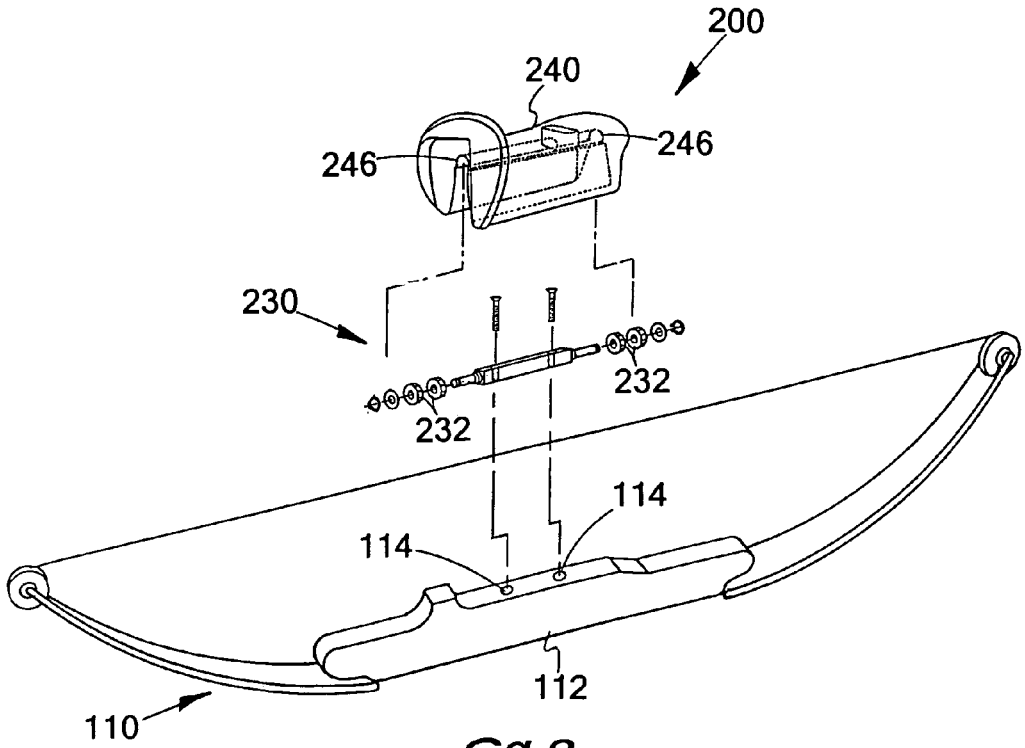
FIG. 8 depicts an exploded perspective view of a second bow grip assembly 200 of this invention mounted on a bow 110.
Figure 9:
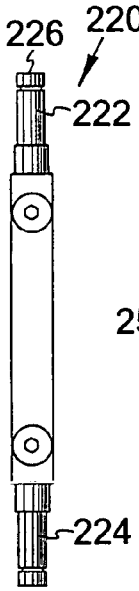
FIG. 9 depicts a top plan view of bearing support assembly 220 for second bow grip assembly 200 of this invention.
Figure 10:
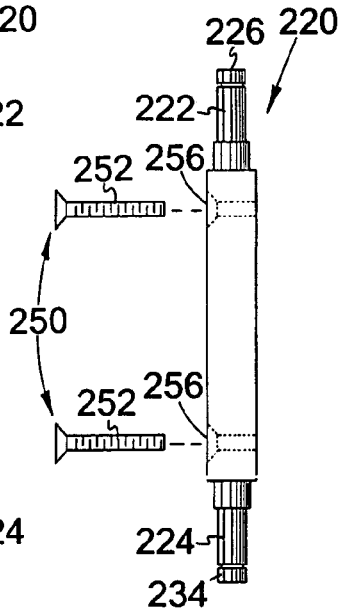
FIG. 10 depicts a side view of bearing support assembly 220 for second bow grip assembly 200 of this invention.
Figure 12:
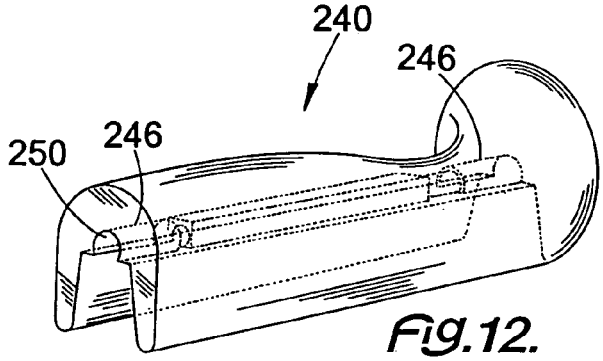
FIG. 12 depicts a perspective view of second hand grip 240 for second bow grip assembly 200 of this invention.
Figure 13:
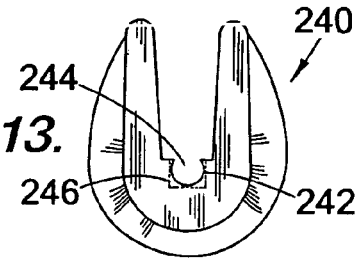
FIG. 13 depicts a bottom plan view of second hand grip 240 for second bow grip assembly 200 of this invention.
Figure 11:
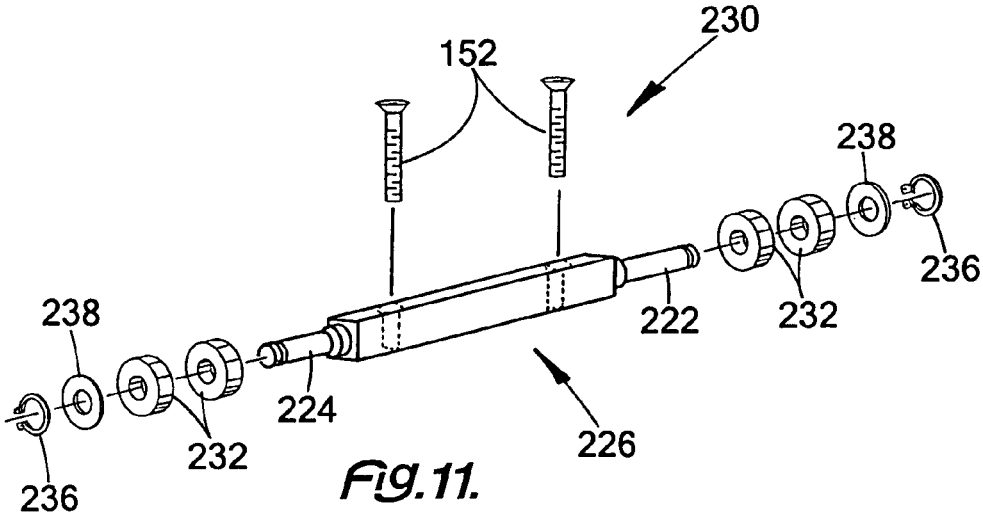
FIG. 11 depicts an exploded perspective view of bearing assembly 230 for second bow grip assembly 200 of this invention.
Figure 14:
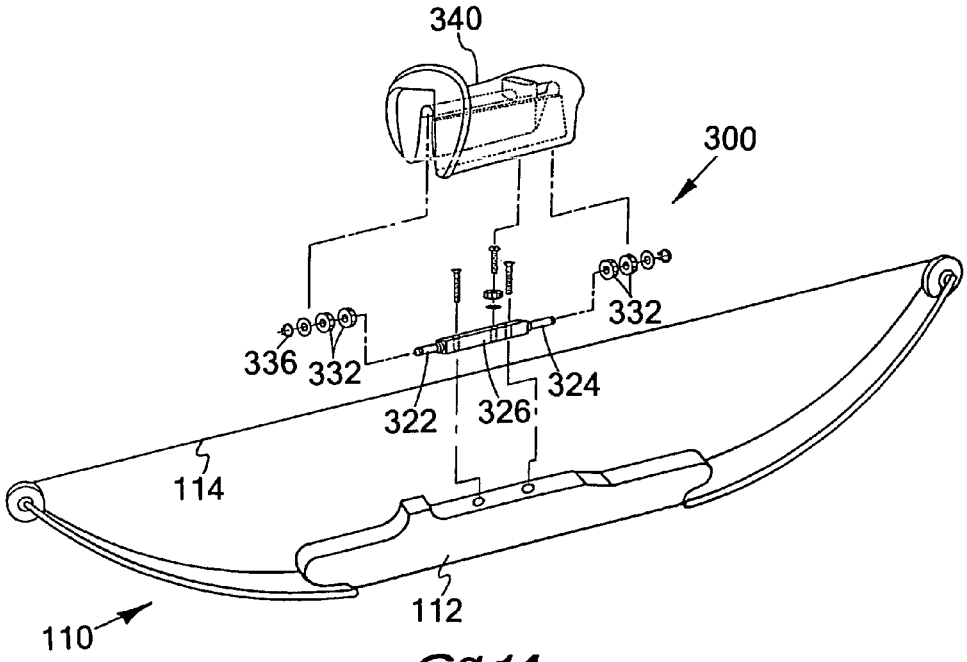
FIG. 14 depicts an exploded perspective view of a triple bow grip assembly 300 of this invention mounted on a bow 110.
Figure 15:
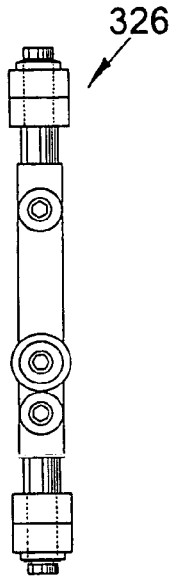
FIG. 15 depicts a top plan view of triple bearing support assembly 320 for triple bow grip assembly 300 of this invention.
Figure 16:
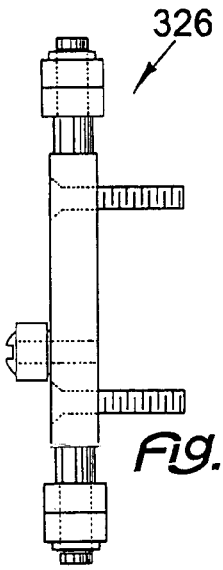
FIG. 16 depicts a side view of triple bearing support assembly 320 for triple bow grip assembly 300 of this invention.

A second embodiment of this invention is depicted in FIG. 8, FIG. 9, FIG. 10, FIG. 11, FIG. 12 and FIG. 13. Second bow grip assembly 200 allows for the elimination of end transverse bearing 134 as depicted in FIG. 8 when compared to FIG. 2. Ball bearings 232 are located on the first ball end 222 and the second ball end 224 of ball bearing support shaft 226 as depicted in FIG. 11. Although the use of ball bearings 232 is preferred, needle bearings, sleeve bearings, journal bearings or other types of bearings may be used. Bearings 232 are held in place on bearing support shaft 226 using snap rings 236, c-clips or some other suitable means.

While it is not desired to be limited by a specified use because other uses may be possible, it is felt that bow 110 is most usually a bow with a slight horizontal grip seat, when first bow grip assembly 100 or triple bow grip assembly 300 is used. Likewise, it is felt that bow 110 is most usually a bow with a vertical grip seat, when second bow grip assembly 200 is used.

Although the use of a washer 238 between bearings 232 and snap ring 236 is preferred, it is not required. Also, the use of two ball bearings 232 on the first end 222 and the second end 224 of bearing support shaft 226 is preferred, however, one ball bearing 232 or more than two ball bearings 232 can be used at each end of the bearing support shaft 226.

Bearing assembly 230 is attached to bow riser 112 of bow 110 using screw assembly 250. Screws 252 pass through bearing support shaft apertures 256 and received by bow riser apertures 114. The use of screw assembly 250 allows for a secure attachment of bearing assembly 230 to the bow riser 112.

The method of snapping the handle or second hand grip 240 on the ball bearings 232 is clear from the drawings of the plastic grip 240. Plastic grip 240 includes bearing seats 242. With a fitting site 244 portion of the bearing seats 242 cut out, the plastic second hand grip 240 has snap fit member 246, which will snap over the ball bearings 232.

Any upward thrust that occurs while the bow string 114 is being pulled will be supported by the normal side thrust tolerances of ball bearings 232. Also, the distance between snap fit members 246 as depicted in FIG. 11 is such that snapping of bow grip handle 240 onto bearings 232 does not allow grip 240 to move in a direction parallel to bow riser 112, and yet allows grip 240 to move freely about a vertical axis. The combination of snap fit member 246 snapped onto ball bearings 232 allows for second hand grip 240 to remain very secure on the bearing assembly 230. This also makes the second hand grip 240 easy to remove if necessary.

Similar to the first embodiment of this invention, by allowing the second hand grip 240 to move on ball bearings 232 while bow string 114 of bow 110 is drawn, the second bow grip assembly 200 in this invention is free to move without friction and minimizes or practically eliminates the effect of an archer not placing his or her hand in the exact place on second hand grip 240 every time he or she shoots an arrow. This invention even minimizes the effect of an archer wearing gloves. This invention provided by the second bow grip assembly 200 also minimizes or practically eliminates the effect of any change in the wrist position and the effect of flinching by the archer.

Movement of second hand grip 240 around a vertical axis also minimizes the effect of twisting of bow 110 caused by torque forces when bow string 114 is pulled. Minimization of the effect of those torque forces thereby minimizes the difference between the location of where an arrow is actually aimed and where the archer's sighting mechanism(s) show the archer where the arrow is aimed.

In FIG. 11, ball bearings 232 are mounted at a first end 222 and a second end 224 of bearing support shaft 226. The bottom of bearing support shaft 226 and prevents upward and downward movement of plastic second hand grip 240 when bearing 232 fits within slot 246 inside the plastic second hand grip 240.

Slot 246 within plastic second hand grip 240 is machined so that the ball bearing 132 will not move up or down inside the plastic grip 230. This plastic second hand grip 240 is also machined to snap onto the needle bearing support assembly 220.

Figure 17:
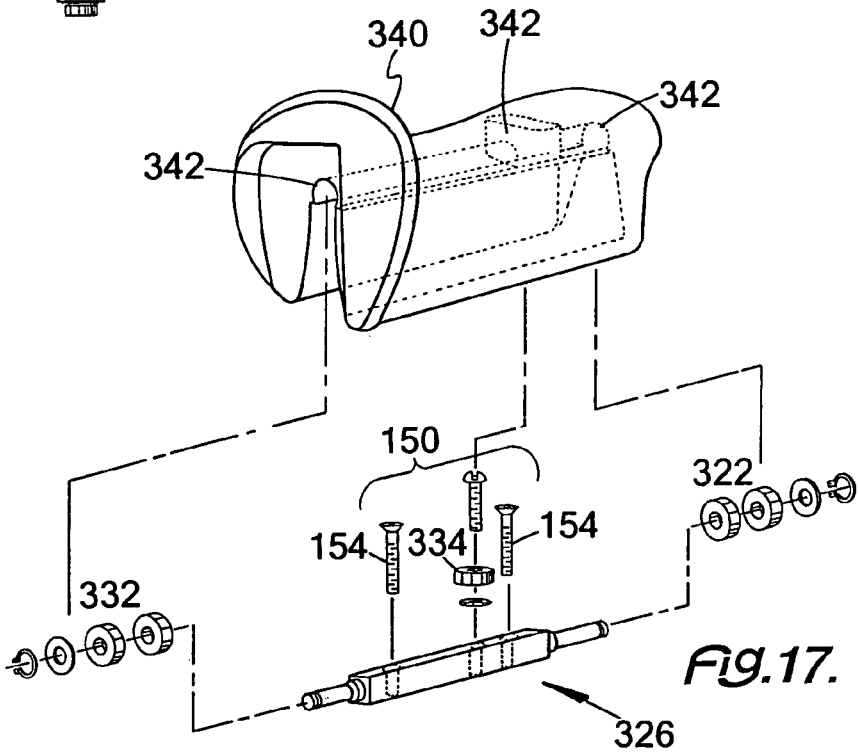
FIG. 17 depicts an exploded perspective view of triple bearing support assembly 320 for triple bow grip assembly 300 of this invention.
Figure 18:
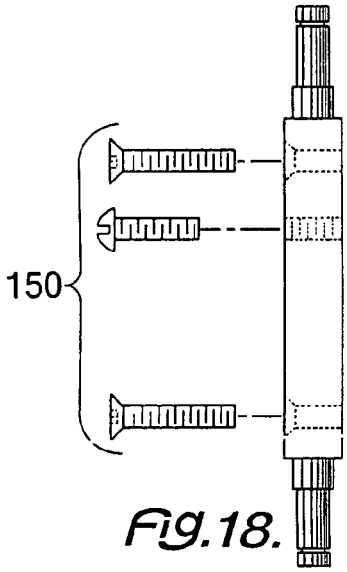
FIG. 18 depicts a side view of triple bearing support assembly 320 for triple bow grip assembly 300 of this invention.
Figure 20:
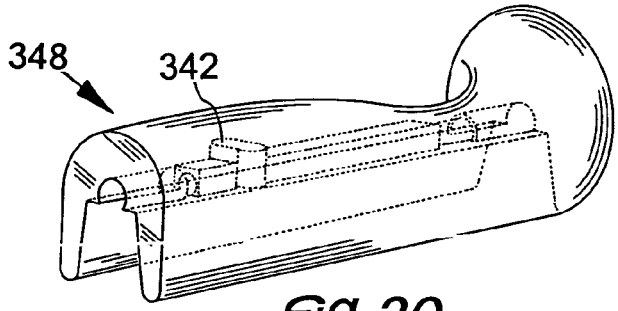
FIG. 20 depicts a perspective view of triple plastic grip 340 for triple bow grip assembly 300 of this invention.
Figure 19:
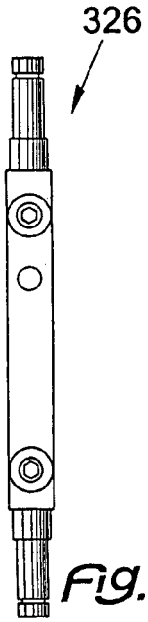
FIG. 19 depicts a top plan view of triple bearing support assembly 320 for triple bow grip assembly 300 of this invention.

A third embodiment of this invention is depicted in FIG. 14, FIG. 15, FIG. 16, FIG. 17, FIG. 18, FIG. 19 and FIG. 20. Triple bow grip assembly 300 allows for the repositioning of end transverse bearing 134 to middle transverse bearing 334 as depicted in FIG. 8 when compared to FIG. 17. End bearings 332 are located on the first triple end 322 and the second triple end 324 of ball bearing triple shaft 326 as depicted in FIG. 17. Although the use of ball bearings 232 is preferred, needle bearings, sleeve bearings, journal bearings or other types of bearings may be used. End bearings 332 are held in place on bearing triple shaft 326 using slip rings 336, c-clips or some other suitable means.

Although the use of a washer 238 between bearings 332 and slip ring 336 is preferred, it is not required. Also, the use of two ball bearings 232 on the first triple end 322 and the second triple end 324 of triple bearing support shaft 326 is preferred, however, one ball bearing 232 or more than two ball bearings 232 can be used at each end of triple bearing support shaft 326.

Triple bearing assembly 330 is attached to bow riser 112 of bow 110 using screw assembly 250. Screws 252 pass through bearing support shaft apertures 256 and received by bow riser apertures 114. The use of screw assembly 250 allows for a secure attachment of bearing assembly 230 to the bow riser 112.

The method of snapping the handle or triple hand grip 340 on the ball bearings 232 is clear from the drawings of the triple hand grip 340. Triple hand grip 340 includes triple bearing seats 342. With a triple fitting site 344 portion of the each triple bearing seats 342 cut out, the plastic triple hand grip 340 has triple snap fit member 348, which will snap over the ball bearings 232.

Any upward thrust that occurs while the bow string 114 is being pulled will be supported by the middle transverse bearing 334. Triple bearing assembly 340 thus offers advantages of the other assemblies disclosed herein.

Figure 21:
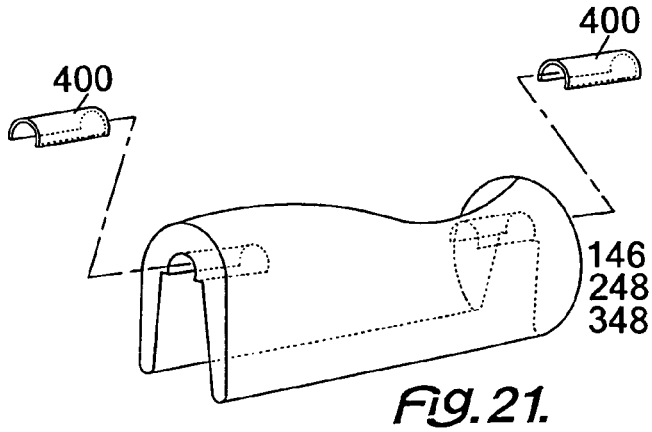
FIG. 21 depicts an exploded view of rubber sleeves 400 for plastic second hand grip 240.

With FIG. 21 depicting rubber sleeves 400 slipped into each end of any hand grip herein, noise is reduced and shock absorption is accomplished. Each of triple hand grip 340, first hand grip 140 and second hand grip 240 can receive rubber sleeves 400 therein because the structure is similar at that point. Rubber sleeves 400 provide shock absorption and noise reduction.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed is:

1. A bow grip assembly for at least minimizing the effect of twisting of a bow as an arrow is aimed and released therefrom comprising;

(a) the bow grip assembly having a grip member and bearing member;

(b) the grip member having slots;

(c) the bearing member having a bearing support shaft;

(d) the bearing member having a transverse bearing support bracket;

(e) the bearing support shaft having bearings;

(f) the transverse bearing support bracket having a bearing;

(g) the slots in the grip member receiving the bearings on the bearing support shaft;

(h) the slots in the grip member receiving the bearing on the transverse bearing support bracket; and (i) the grip member rotating freely about an axis.

2. The bow grip assembly in claim 1 further comprising:

(a) the bearing support shaft having a screw assembly;

(b) the bearing support shaft having bearings located on a first end and bearings located on a second end oppositely disposed from the first end of the bearing support shaft;

(c) the transverse bearing support bracket having a bearing located on it; and (d) the grip member having bearing seats.

3. The bow grip assembly in claim 2 further comprising:

(a) the screw assembly having at least one screw;

(b) the bearings on the bearing support shaft being ball bearings;

(c) the bearing on the transverse bearing support bracket being a ball bearing; and (d) the grip member having bearing seats with dimensions approximately equivalent to the diameter and the thickness of the bearings on the bearing support shaft.

4. The bow grip assembly in claim 3 further comprising:

(a) the screw assembly having at least two screws;

(b) the screws of the screw assembly passing through apertures in the bearing support shaft and received by apertures in a bow riser; and (c) a bearing assembly securely attached to the bow riser.

5. The bow grip assembly in claim 4 further comprising:

(a) a bow grip with a fitting site portion of the bearing seats cut out;

(b) the bow grip with bearing seats receiving a bearing assembly securely attached to the bow riser;

(c) the bow grip with a slot receiving a bearing on the transverse bearing support bracket; and (d) the bow grip securely attached the bearing assembly and free to move about an axis parallel to the bow riser.

6. A bow grip assembly for at least minimizing the effect of twisting of a bow as an arrow is aimed and released therefrom comprising;

(a) the bow grip assembly having a grip member and bearing member;

(b) the grip member having slots;

(c) the bearing member having a bearing support shaft;

(d) the bearing support shaft having bearings;

(e) the slots in the grip member receiving the bearings on the bearing support shaft;

(f) the grip member rotating freely about an axis.

7. The bow grip assembly in claim 6 further comprising:

(a) the bearing support shaft having a screw assembly;

(b) the bearing support shaft having bearings located on a first end and bearings located on a second end oppositely disposed from the first end of the bearing support shaft; and (c) the grip member having bearing seats.

8. The bow grip assembly in claim 7 further comprising:

(a) the screw assembly having at least one screw;

(b) the bearings on the bearing support shaft being ball bearings; and (d) the grip member having bearing seats with dimensions approximately equivalent to the diameter and the thickness of the bearings on the bearing support shaft.

9. The bow grip assembly in claim 8 further comprising:

(a) the screw assembly having at least two screws;

(b) the screws of the screw assembly passing through apertures in the bearing support shaft and received by apertures in a bow riser; and (c) a bearing assembly securely attached to the bow riser.

10. The bow grip assembly in claim 9 further comprising:

(a) a bow grip with a fitting site portion of the bearing seats cut out;

(b) the bow grip with bearing seats receiving a bearing assembly securely attached to the bow riser; and (c) the bow grip securely attached the bearing assembly and free to move about an axis parallel to the bow riser.

* * * * *